United States Patent [19]

Phlaum

[11] 3,938,946

[45] Feb. 17, 1976

[54] IGNITION ENHANCER FOR STARTING PILOT BURNERS

[75] Inventor: Edward G. Phlaum, Kankakee, Ill.

[73] Assignee: A. O. Smith Corporation, Milwaukee, Wis.

[22] Filed: Feb. 7, 1975

[21] Appl. No.: 547,869

[52] U.S. Cl. ..... 431/264; 431/263

[51] Int. Cl.[2] ..... F23Q 3/00

[58] Field of Search ..... 431/263, 264, 266, 255, 431/352

[56] References Cited

UNITED STATES PATENTS

| | | | |
|---|---|---|---|
| 3,302,687 | 2/1967 | Gjerde | 431/266 |
| 3,729,288 | 4/1973 | Berlincourt et al. | 431/264 |

*Primary Examiner*—Edward G. Favors

*Attorney, Agent, or Firm*—Andrus, Sceales, Starke & Sawall

[57] ABSTRACT

A gas diffuser screen surrounding a pilot burner and with one of the perforated walls of the screen slanted outwardly at an angle approximately forty-five degrees from the vertical and overlying an electrode spark igniter to ignite the gas supplied to the burner. The slanted wall forms a pocket of gas beneath the wall thereby permitting greater latitutde in placement in any direction of the electrode igniter outside the screen with respect to the pilot burner without adversely affecting the spark ignition of the gas supplied to the pilot burner.

4 Claims, 2 Drawing Figures

IGNITION ENHANCER FOR STARTING PILOT BURNERS

BACKGROUND OF THE INVENTION

In prior practice the electrode igniter used to produce a spark to ignite pilot burners employed in lighting gas burners such as those used in water heaters was located inside the gas diffuser screen normally surrounding the pilot burner. The present invention locates the electorde ignition igniter outside the screen and beneath an outwardly angularly slanted wall of the screen. Gas supplied to pilot burners for igniting the burner is spread out in a greater area by the slant of the screen wall and forms a pocket of gas beneath the wall. Consequently the electorde igniter can be located within defined tolerance limits in any direction with respect to the pilot burner which eliminates a critical securement of the electrode igniter in a position with respect to the pilot burner.

SUMMARY OF THE INVENTION

In general the invention is directed to an electorde igniter actuated by striking a piezoelectric crystal by a spring operated actuator to create a spark which is discharged from an electrode connected to the crystal. The igniter electrode is located outside of an apertured screen which surrounds a pilot burner and beneath a side wall of the screen which is angularly slanted at approximately 45° from the vertical outwardly of the screen from the vertical and over the igniter electrode. Because of the slant of the screen the gas from the pilot burner when the latter is to be ignited is spread over the face of the slanted wall of the screen and forms a pocket of gas beneath the screen. Consequently the igniter electrode may be located beneath the screen in line with the pilot burner plus or minus one-eighth of an inch sideways of the pilot burner or upwardly, downwardly or inwardly or outwardly thereof. The screen surrounding the pilot burner and the piezoelectric crystal may be secured to a common bracket to provide a ground connection between the screen and crystal.

DESCRIPTION OF THE INVENTION

Figure 2:
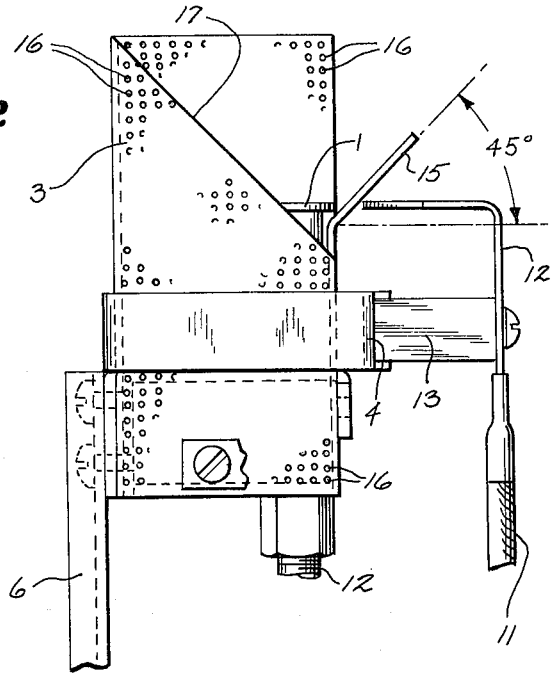
FIG. 2 is a side elevational view of the assembled electrode igniter and screen.
Figure 1:
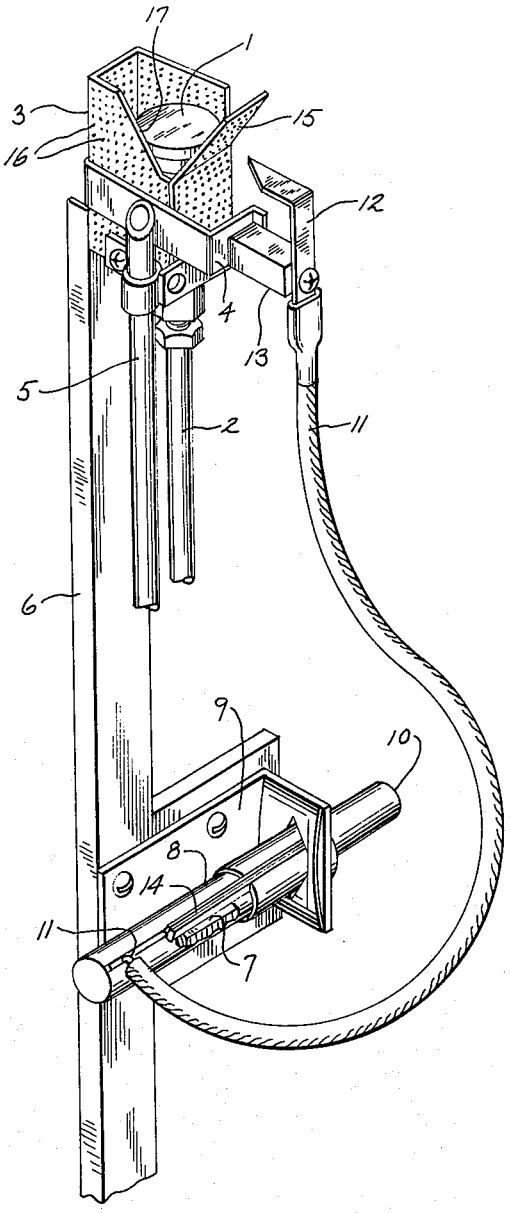
FIG. 1 is a perspective view of the electrode igniter with a pilot burner surrounded by a gas diffuser screen and having a slanted wall overlying the electrode igniter with the screen and piezoelectric crystal grounded through a supporting bracket and with parts broken away.

Referring to the drawings there is shown a pilot burner 1 connected to a source of gas by pipe 2 and located within the perforated open top gas diffuser screen or housing 3. Screen 3 in encircled by the bracket 4 to which is secured the bleeder 5 in turn connected to a gas valve or regulator (not shown) to burn excess gas which might escape from the unit employed to control gas flow. The bracket 4 also is employed to secure the screen to the upright support 6.

A piezoelectric crystal 7, only a portion of which is shown, of the well-known type is disposed within housing 8 and is secured by bracket 9 to the lower end of support 6. Support 6 provides a common electrical ground between the crystal 7 and screen 3. Crystal 7 is actuated by a spring operated (not shown) striker push button 10 and is connected by conductors 11 to the electrode 12 which is secured through the insulating member 13 to bracket 4. When button 10 is depressed to strike crystal 7 an electric current is created which passes through conductor 11 to electrode 12 and a spark is generated at the tip of the electrode as the current jumps from the electrode 12 to screen 3 and then returns through bracket 4 and the conductor 14 inset within crystal housing 8 to crystal 7 located inside the housing 8.

Diffuser screen 3 is constructed so that one wall 15 is slanted outwardly from the vertical and overlies the electrode 12. For successful operation of the described ignition enhancer apparatus the slant of wall 15 should be at an angle of approximately 45° from the vertical plus or minus two and one-quarter degrees. By slanting wall 15 at the angle described when gas flows to the pilot burner 1 it expands inside of screen 3 and passes through the perforations 16 in wall 15 (the perforations likewise being provided in the other walls of screen 3) with the result that it spreads out and forms a pocket of gas beneath wall 15. If the angular slant of wall 15 is too little or extends in a vertical plane then the gas passing through the perforations in wall 15 is wiped away by the vertical movement of air flowing upwardly pass wall 15. If the slant of wall 15 is too great then the pocket of gas is not formed under the wall 15 but rather is carried off over the inside of the screen by the expansion of the gas.

Because of the formation of a pocket of gas beneath wall 15, the location of electrode 12 with respect to pilot burner 1 becomes less critical and the tolerance limits in locating the electrode become greater. Experience has indicated that placement of the electrode spark igniter 12 beneath wall 15 of screen 3 permits tolerance limits of plus or minus one-eighth inch with respect to alignment of electrode 12 with burner 1 in any direction i.e., sideways of the burner 1 or upwardly or downwardly with respect to the horizontal plane in which the burner 1 and electrode 12 normally lie or inwardly or outwardly of burner 1. Widening of the tolerance limits does not affect the ignition characteristics of the assembly.

The screen 3 is illustrated with an opening 17 in the forward wall and although this is desirable with respect to the diffusing or expansion of the gas flowing into the pilot burner 1 inside of screen 3 it has no bearing on the present invention.

The perforations 16 preferably should be approximately thirty by thirty mesh for the best operation because the size of the perforations or apertures 16 will have some bearing upon the tolerance limits in the location of electrode 12 with respect to pilot burner 1. If the size of perforations 16 is too small and heavy gas like propane is employed the gas will not satisfactorily flow through the perforations 16 to form a pocket of gas under wall 15. If perforations 16 are too large then so much gas will pass through perforations 16 that the gas will be carried away by air flowing past wall 15.

The invention provides an effective construction for igniting gas supplied a pilot burner by a spark generated in a piezoelectric crystal and permits considerable latitude in placement of the electrode of the unit with respect to the pilot burner without adversely affecting the ignition characteristics of the ignition enhancer.

Various modes of carrying out the invention are contemplated as being within the scope of the following claims particularly pointing out and distinctly claiming the subject matter which is regarded as the invention.

I claim:

1. An ignition enhancer for pilot burners and the like, which comprises a pilot burner, means supplying gas to the pilot burner, a gas diffuser housing having a plurality of apertures in at least one wall thereof and disposed around the pilot burner, means securing the housing to a support, one of the walls of the housing having the apertures therein being slanted outwardly at an angle of approximately forty-five degrees from the vertical to confine a pocket of gas beneath the slanted wall when gas is supplied to the burner and passes through the slanted wall, an igniter electrode capable of providing a spark secured beneath the slanted wall of the housing substantially in line with the pilot burner but located within tolerance limits in any direction of plus or minus one-eighth inch with respect to the pilot burner without adversely affecting the spark ignition of gas supplied to the pilot burner.

2. The construction of claim 1, in which the angle of the slant of the apertured wall is plus or minus two and one-quarter degrees from forty-five degrees.

3. The construction of claim 1, and a piezoelectric crystal connected to the electrode and grounded through said housing for producing a spark between the electrode and housing.

4. The construction of claim 1, in which the housing is a screen in which the apertures therein are of the order of thirty by thirty mesh.

* * * * *